United States Patent [19]

Woodward

[11] Patent Number: 5,049,883

[45] Date of Patent: Sep. 17, 1991

[54] COMBINED MICROWAVE AND INFRARED CHAFF

[75] Inventor: Elmer D. Woodward, Los Altos, Calif.

[73] Assignee: The United States of America as represented by the Secretary of the Navy, Washington, D.C.

[21] Appl. No.: 915,031

[22] Filed: May 30, 1978

[51] Int. Cl.[5] ..... H01Q 15/00; F42B 12/68

[52] U.S. Cl. ..... 342/12; 342/5; 102/504; 102/505

[58] Field of Search ..... 343/18 B, 18 A; 244/3.16; 250/526; 102/89 CD, 60, 63, 87, 504, 505; 342/5, 12

[56] References Cited

U.S. PATENT DOCUMENTS

| | | | |
|---|---|---|---|
| 2,953,377 | 9/1960 | Brust | 343/18 B |
| 3,118,638 | 1/1964 | Rohr | 244/3.16 |
| 3,830,671 | 8/1974 | McArdle | 102/90 |
| 3,836,968 | 9/1974 | Schillref | 343/18 B |
| 3,863,254 | 1/1975 | Turner | 343/18 B |
| 3,878,524 | 4/1975 | Olstowski | 343/18 B |

*Primary Examiner*—Linda J. Wallace

*Attorney, Agent, or Firm*—Harvey Fendelman; Thomas Glenn Keough

[57] ABSTRACT

A long, slender thread or filament of a slow-burning substance is metallized, by evaporation, cold-spraying, or the like, with aluminum, zinc or other similar substance. A short length at one end is not metallized but is provided with means for igniting the filament when the chaff is dispensed. A bundle of these filaments are then packed in an impermeable foil envelope and preferably filled with an inert atmosphere. When dispensed, the cloud of slow-burning filaments perform toward infrared search or tracking devices in a manner analogous to the clutter signal created in radars by conventional chaff. At the same time, the metallic coating on the filament acts as a conventional chaff, giving a capability to interfere with either infrared or microwave devices and devices with a combination of infrared and microwave capabilities.

10 Claims, 1 Drawing Sheet

COMBINED MICROWAVE AND INFRARED CHAFF

BACKGROUND OF THE INVENTION

The present invention relates generally to a countermeasure that is effective against both microwave radars and infrared sensors, either separately or simultaneously. For example, interceptor aircraft commonly are armed with a mix of weapons, some controlled by radar and others homing on infrared radiation from the target aircraft. A target aircraft utilizing the present invention can protect itself against either or both types of attack. A similar usefulness applies to aircraft flying over a battlefield on which anti-aircraft weapons comprising radar controlled guns, radar-controlled missiles, microwave homing missiles, and infrared homing missiles are all likely to be present. The countermeasure disclosed herein can act simultaneously to degrade the performance of any combination of these threat weapons.

Previously, separate countermeasures were required for microwave and for infrared threats. This duplication extends to storage volume and control means and inevitably leads to greater weight and cube requirements and more complexity of the installation than the combined countermeasure of the present invention. Furthermore, in order to be prudent and thrifty in the use of this greater weight and cube, it is desirable to provide sensor input to allow a decision as to which type of countermeasure to use in a given threat situation. These sensors in turn require weight, space and power allocations and increase the workload of the pilot or ECM operator.

SUMMARY OF THE INVENTION

The present invention relates to a bundle of long, slender threads or filaments of a slow-burning substance each of which has a metallized portion and a short length at one end which is not metallized but is coated in an inert atmosphere with a substance which will ignite spontaneously on contact with air. The filaments are then packed in impermeable foil envelopes filled with the inert atmosphere. When dispensed, the foil envelopes are torn open and the spontaneously combustible material ignites on contact with air, in turn igniting the self-sustaining flammable filament. The cloud of slow-burning filaments then performs toward infrared search of tracking devices in a manner analogous to the clutter signal created in radars by conventional chaff. At the same time the metallic coating on the filament acts as such conventional chaff thus giving a capability to interfere with either infrared or microwave devices and devices with the combination of infrared and microwave capabilities. The microwave reflectivity of each filament will have its peak at any instant at the wavelength which is twice the length to which the filament has burned. However, there will also be an appreciable echo at wavelengths shorter than this resonant wavelength although reflection of longer wavelengths will decrease rapidly after the filament burns down past the resonant length. If it is desired to interfere only with shorter wavelength radars, the coating of metal over the entire filament can be replaced by a number of resonant half wavelength bands separated by their own length on the filament.

The heat generated by the burning filament cloud will heat the air in which the cloud is floating, making it buoyant with respect to the surrounding atmosphere so it will tend to rise, thus slowing the fall rate and prolonging the float time of the chaff cloud. If a proportion of ordinary metallized nylon or metallized fiberglass chaff is mixed in with the combustible chaff it will also have its fall rate decreased and its float time increased.

The currents of heated air generated by the flammable chaff will also increase the turbulence of the air occupied by the cloud which in turn will increase the internal velocity of the cloud broadening its Doppler spectral width thereby reducing the degree of cancellation of the chaff echoes achievable by MTI radars.

STATEMENT OF THE OBJECTS

Accordingly, it is the primary object of the present invention to disclose a countermeasure chaff which is effective against both microwave radars and infrared sensors, either separately or simultaneously.

Other objects, advantages and novel features of the invention will become apparent from the following detailed description of the invention when considered in conjunction with the accompanying drawings.

DESCRIPTION OF THE PREFERRED EMBODIMENT

Figure 1:
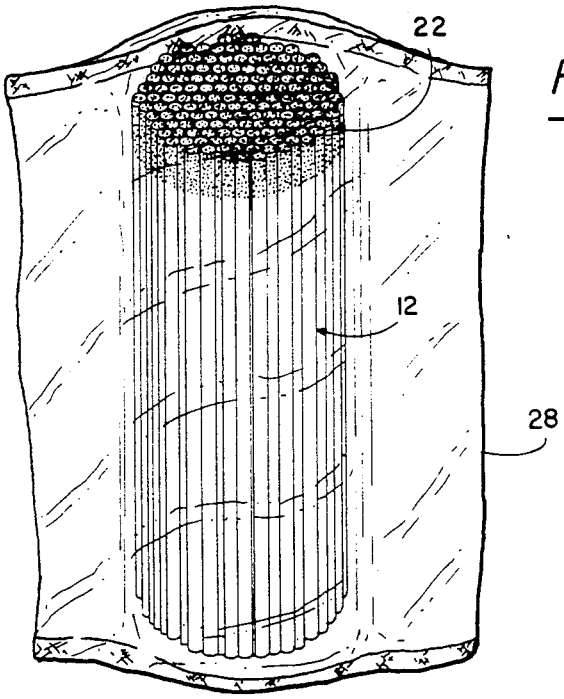
FIG. 1 is a perspective view of a bundle of the chaff dipoles constructed in accordance with the present invention.
Figure 2:
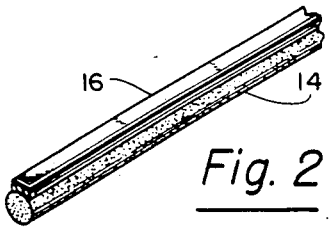
FIG. 2 is a perspective view of one embodiment of the filaments according to the present invention.
Figure 3:
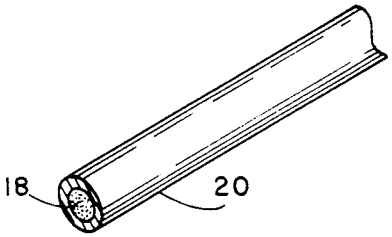
FIG. 3 is a perspective view of an alternative embodiment of the filaments in accordance with the present invention.

Referring now to FIG. 1 it is seen that the present invention is comprised of a bundle 12 of fine strands of a slow-burning substance such as slightly nitrated cellulose, coated with a thin film of a suitable metal such as aluminum or zinc. Referring to FIG. 2 there is illustrated a perspective view of a portion of one such strand of slow burning substance. The strand 14 has a metal stripe 16 extending along the length thereof. Referring to FIG. 3, an alternative embodiment is illustrated wherein strand 18 has a metal coating 20 deposited thereon as by evaporation, cold-spraying or any other suitable technique. In the preferred embodiment of the present invention the one end of each of the filaments comprising the bundle 12 is coated with a match composition 22 to be described below.

The metallized strands are ignited at one end and dispersed in large numbers from the threatened aircraft. The burning strands constitute a volumetric heat source, the infrared emissions from which will mask the infrared sources from the aircrafts and disrupt tracking and/or homing by infrared sensors.

The metal coating acts as conventional microwave chaff, confusing and disrupting the radar echo of weapon-control radars and tending to "break lock" of microwave homing missiles.

Figure 4:
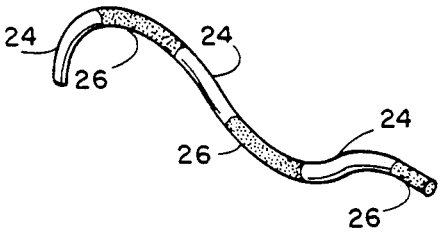
FIG. 4 is a perspective view of an alternative filament in accordance with the present invention particularly suitable as a countermeasure towards short wavelength radars.

A coating of metal such as 16 or 20 which is sufficient to act as an efficient microwave reflector can be light enough to be completely vaporized and consumed by the heat of the burning strand, leaving no residue. This would be an advantage in training since residue from chaff falling to the ground has sometimes been poisonous to grazing animals. Alternatively, the metal coating can be made robust enough to survive when the strand burns so as to leave a cloud of conventional chaff. On the other hand if the metal coat is made very thin, less than the "skin thickness" corresponding to the particular metal and microwave frequency, and the strand is compounded with some substance such as carbon black which will make it a resistive conductor, this invention will function as "absorptive chaff" which absorbs rather than reflects microwave energy and acts to screen targets when it is between them and the microwave radar sensor. The microwave reflectivity of each burning filament will depend on the relation of the length of the metallized part of the filament to the wavelength of the microwave radiation. At any particular instant, the reflectivity will be a maximum at a wavelength which is very nearly twice the length to which the filament has burned (in the alternative embodiments in which the metal is consumed by the combustion). However, there will also be an appreciable echo at wavelengths shorter than this resonant wavelength, although reflection of longer wavelengths will decrease rapidly after the filament burns down past the resonant length. If it were desired to interfere only with short-wavelength radars, the coating of metal over the entire filament can be replaced with a number of resonant half-wavelength bands 24 separated by their own length on the strand 26 of coated combustible filament as is illustrated in FIG. 4.

The heat generated by the burning filament cloud will heat the air in which the cloud is floating, making it buoyant, with respect to the surrounding atmosphere so it will tend to rise, thus slowing the fall rate and prolonging the float time of the chaff cloud. If a proportion of ordinary metallized nylon or metallized fiberglass chaff is mixed in with the combustible chaff, it too will have its fall rate decreased and its float time increased. The currents of heated air generated by the burning filaments will also increase the turbulence of the air occupied by the cloud which in turn will increase the internal velocity components of the cloud, broadening its Doppler spectral width and thereby reducing the degree of cancellation of the chaff echoes achievable by MTI radars.

Various means of igniting the filaments are possible. One way is to make parallel bundles of the filaments, coat one end of the bundle with a low ignition temperature match substance and package the bundle in a conventional chaff dispensing cartridge compatible with many existing chaff systems, with the match coat end embedded in the ejection powder charge. Another method as is illustrated in FIG. 1 is to coat one end of each filament with a match substance 22 which will ignite upon exposure to air and to package the chaff filaments in a foil envelope 28 illustrated in transparency for the purpose of clarity. The foil envelope 28 is then filled with an inert gas. When dispensed, the envelope is torn open and the strands ignite spontaneously on contact with air. An alternative method is to use a match coat on the end of the filaments to be ignited and to package the filaments in a foil envelope filled with a gas which ignites when mixed with air, such as phosphine. Dyes or other additives may be incorporated in the combustible strand to alter the spectral characteristics of its infrared emissions.

Thus a novel chaff has been disclosed that combines combustible infrared countermeasures with microwave chaff. This combination of a combustible substance with a metallized filament results in a novel chaff that utilizes the buoyancy and hot air currents from combustion of the combined chaff itself to decrease its rate of fall and increase its turbulent motion and also to impart the same effects to ordinary microwave chaff which may be mixed, if desired, with the combined chaff according to the present invention. The present invention also lends itself readily to the formation of an "absorptive chaff" by the combination of a plastic filament compounded as a resistive conductor with a coating or stripe of metal of less than a skin thickness in accordance with the present invention.

Obviously many modifications and variations of the present invention are possible in the light of the above teachings. It is therefore to be understood that within the scope of the appended claims the invention may be practiced otherwise than as specifically described.

What is claimed is:

1. A microwave and infrared countermeasure chaff comprising:

a bundle of slow burning filaments, each said filament having a metallized coating extending along at least a portion of the surface thereof; and said bundle having means disposed thereon for igniting said filament.

2. The chaff of claim 1 wherein said igniting means comprises means for igniting upon contact with air.

3. The chaff of claim 2 wherein said chaff further comprises an impermeable envelope encompassing said bundle of fibers.

4. The chaff of claim 3 wherein said impermeable envelope is a foil envelope.

5. The chaff of claim 4 wherein said envelope is filled with an inert atmosphere.

6. The chaff of claim 1 wherein, upon combustion, said slow burning filaments act to heat the surrounding air to thereby slow the fall rate of said chaff.

7. The chaff of claim 1 wherein said slow burning filament comprises nitrated cellulose.

8. The chaff of claim 1 wherein said igniting means comprises a low-ignition-temperature substance for embedding in an ejection powder charge and for igniting upon ignition of said ejection powder charge.

9. The chaff of claim 1 wherein said chaff further comprises an envelope encompassing said filaments, said envelope being filled with a gas that ignites upon contact with air; and said igniting means comprises a low-ignition-temperature substance whereby said substance is ignited upon combustion of said gas.

10. The chaff of claim 9 wherein said gas is phosphine.

* * * * *